US010178922B1

(12) United States Patent
Dasenbrock et al.

(10) Patent No.: US 10,178,922 B1
(45) Date of Patent: Jan. 15, 2019

(54) FLOOR MAT

(71) Applicant: Ebco Inc., Elgin, IL (US)

(72) Inventors: Brian Dasenbrock, Elgin, IL (US); Ryan Matesi, Elgin, IL (US); Matthew Webb, Elgin, IL (US); Peijun Xu, Elgin, IL (US)

(73) Assignee: Ebco Inc., Elgin, IL (US)

( * ) Notice: Subject to any disclaimer, the term of this patent is extended or adjusted under 35 U.S.C. 154(b) by 38 days.

(21) Appl. No.: 15/649,214

(22) Filed: Jul. 13, 2017

(51) Int. Cl.
*B32B 3/30* (2006.01)
*A47G 27/02* (2006.01)

(52) U.S. Cl.
CPC ... *A47G 27/0212* (2013.01); *Y10T 428/24182* (2015.01)

(58) Field of Classification Search
CPC ..... Y10T 428/24182; A47G 27/0212; A47G 27/0231; A47L 23/26; A47L 23/266
See application file for complete search history.

(56) References Cited

U.S. PATENT DOCUMENTS

| | | | |
|---|---|---|---|
| 4,478,901 | A | 10/1984 | Dickens |
| 6,446,275 | B1 | 9/2002 | Wright |
| 6,589,631 | B1 | 7/2003 | Suzuki |
| 6,599,615 | B2 | 7/2003 | Burke, III |
| 6,656,562 | B2 | 12/2003 | Malpass |
| 2003/0186025 | A1 | 10/2003 | Scott |
| 2010/0143645 | A1 | 6/2010 | Wilmsen |
| 2012/0021167 | A1 | 1/2012 | Plant |

*Primary Examiner* — Alexander S Thomas
(74) *Attorney, Agent, or Firm* — McDonnell Boehnen Hulbert & Berghoff LLP

(57) ABSTRACT

The present disclosure provides a mat including a base having a top surface and a bottom surface. The mat also includes a plurality of cylindrical supports extending away from the bottom surface of the base. A first end of each of the plurality of cylindrical supports is coupled to the bottom surface of the base and a second end of each of the plurality of cylindrical supports includes a plurality of semi-circular cutouts spaced apart by a separation distance in a first plurality of rows. Adjacent rows of the first plurality of rows are offset by one half of the separation distance. The mat also includes a plurality of secondary supports extending away from the bottom surface of the base. The plurality of secondary supports are spaced apart by one half of the separation distance in a second plurality of rows on the bottom surface of the base.

19 Claims, 5 Drawing Sheets

FLOOR MAT

FIELD OF THE INVENTION

Generally, the present disclosure relates to a floor mat. Specifically, the present disclosure relates to a floor mat that provides a high level of comfort to the users thereof, even during extended periods of standing. Moreover, the surfaces of the mat exhibit resistance to chemicals, stains, and scuffing. Additionally, these mats have little tendency to absorb water during use. Such mats are suitable for use in a variety of applications where the mats anti-fatigue and other physical properties are desirable.

BACKGROUND

Unless otherwise indicated herein, the materials described in this section are not prior art to the claims in this application and are not admitted to be prior art by inclusion in this section.

For some time now, employers have struggled with how to better protect employees from the rigors of standing in a relatively stationary position for long periods. Individuals who stand for long periods may develop Cumulative Standing Trauma (CST) because of excessive stress on the back, legs, and other various muscles. CST can lead to varicose veins and to arch and heel pain from flattened feet. Such problems can result in increased absenteeism and health care costs for the employer and lower job satisfaction for the employee.

Seeking to minimize the fatigue and discomfort felt by workers standing on concrete or other hard flooring surfaces, employers have used a variety of mats and other flooring articles in an attempt to cushion the work surface where employees stand. To this end, several types of mats or flooring articles have been used to combat CST and to cushion the work surfaces of stationary employees. These mats range from traditional carpeting to mats made from vinyl, rubber, or tufted substrates. When considering industrial uses, such as forklifts in factories, for example, the problems associated with the previous alternatives become clear.

Traditional carpet mats have many drawbacks when used in such industrial applications. In the factory forklift example, carpet mats would tend to collect dirt and other debris, resulting in cleaning difficulties and an undesirable appearance. Users of tufted mats experience similar problems with maintaining the desired appearance of the mats. Another approach consists of an uncarpeted anti-fatigue mats comprised of a sponge-like material, including PVC, vinyl polymers, and polyurethanes, as well as recycled tire rubber. Such mats used in factory environments are deficient for a number of reasons. These mats are generally not able to be easily washed as they absorb liquid, and they deteriorate too easily (since the sponge-like materials are easy to tear apart). As such, there is a need for an improved floor mat that has anti-fatigue characteristics while being constructed of a more durable material for easy cleaning.

SUMMARY

Thus, in one aspect, a mat is provided. The mat includes a base having a top surface and a bottom surface. The mat also includes a plurality of cylindrical supports extending away from the bottom surface of the base. A first end of each of the plurality of cylindrical supports is coupled to the bottom surface of the base, and a second end of each of the plurality of cylindrical supports includes a plurality of semi-circular cutouts. The plurality of cylindrical supports are spaced apart by a separation distance in a first plurality of rows on the bottom surface of the base. Adjacent rows of the first plurality of rows are offset by one half of the separation distance. The mat also includes a plurality of secondary supports extending away from the bottom surface of the base, wherein the plurality of secondary supports are spaced apart by one half of the separation distance in a second plurality of rows on the bottom surface of the base.

These as well as other aspects, advantages, and alternatives, will become apparent to those of ordinary skill in the art by reading the following detailed description, with reference where appropriate to the accompanying drawings.

DETAILED DESCRIPTION

Figure 1:
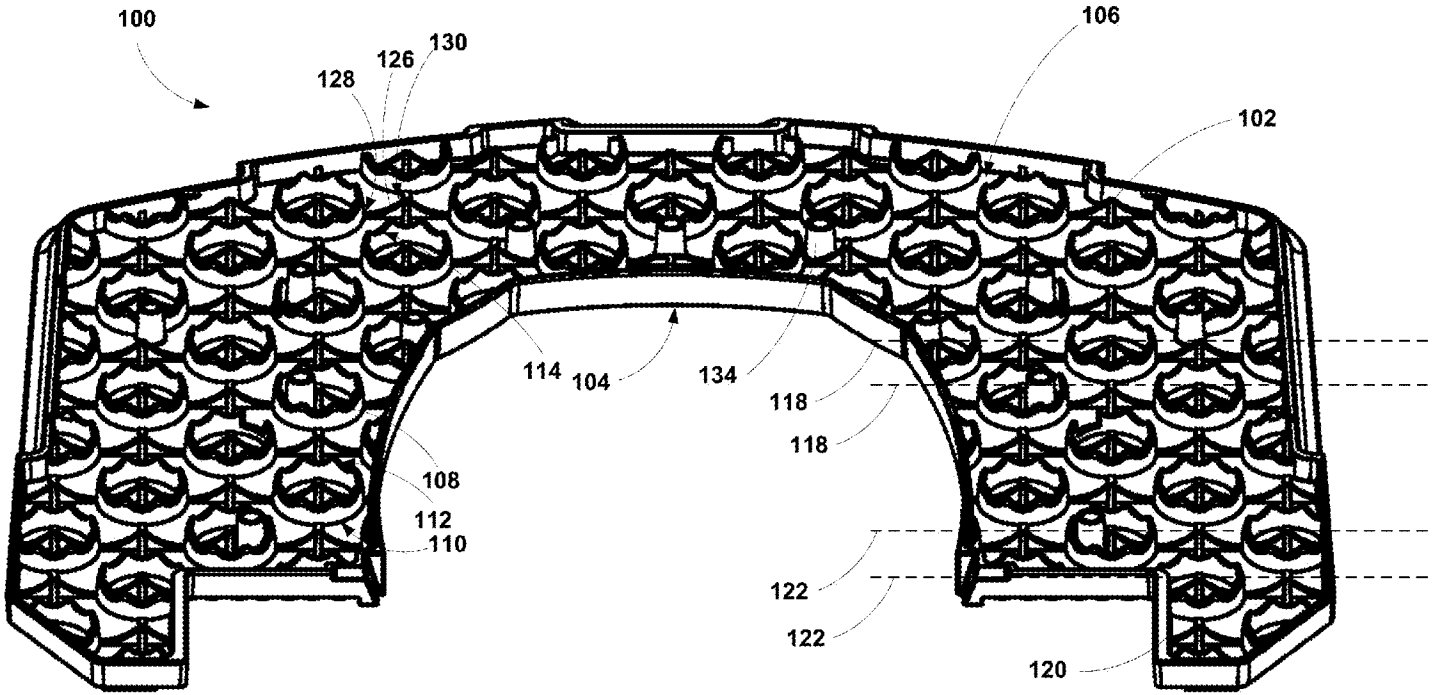
FIG. 1 illustrates a perspective view of a mat, according to an example embodiment.

Example methods and systems are described herein. It should be understood that the words "example," "exemplary," and "illustrative" are used herein to mean "serving as an example, instance, or illustration." Any embodiment or feature described herein as being an "example," being "exemplary," or being "illustrative" is not necessarily to be construed as preferred or advantageous over other embodiments or features. The example embodiments described herein are not meant to be limiting. It will be readily understood that the aspects of the present disclosure, as generally described herein, and illustrated in the figures, can be arranged, substituted, combined, separated, and designed in a wide variety of different configurations, all of which are explicitly contemplated herein.

Furthermore, the particular arrangements shown in the Figures should not be viewed as limiting. It should be understood that other embodiments may include more or less of each element shown in a given Figure. Further, some of the illustrated elements may be combined or omitted. Yet further, an example embodiment may include elements that are not illustrated in the Figures.

As used herein, with respect to measurements, "about" means +/−5%.

As used herein, with respect to measurements, "substantially" means +/−5%.

As used herein, "separation distance" means a distance between a center of a first cylindrical support of the plurality of cylindrical supports to a center of a second cylindrical support of the plurality of cylindrical supports.

As used herein, "coupled" means associated directly as well as indirectly. For example, a member A may be directly associated with a member B, or may be indirectly associated therewith, e.g., via another member C. It will be understood that not all relationships among the various disclosed elements are necessarily represented.

Unless otherwise indicated, the terms "first," "second," etc. are used herein merely as labels, and are not intended to impose ordinal, positional, or hierarchical requirements on the items to which these terms refer. Moreover, reference to, e.g., a "second" item does not require or preclude the existence of, e.g., a "first" or lower-numbered item, and/or, e.g., a "third" or higher-numbered item.

Reference herein to "one embodiment" or "one example" means that one or more feature, structure, or characteristic described in connection with the example is included in at least one implementation. The phrases "one embodiment" or "one example" in various places in the specification may or may not be referring to the same example.

As used herein, a system, apparatus, device, structure, article, element, component, or hardware "configured to" perform a specified function is indeed capable of performing the specified function without any alteration, rather than merely having potential to perform the specified function after further modification. In other words, the system, apparatus, structure, article, element, component, or hardware "configured to" perform a specified function is specifically selected, created, implemented, utilized, programmed, and/or designed for the purpose of performing the specified function. As used herein, "configured to" denotes existing characteristics of a system, apparatus, structure, article, element, component, or hardware which enable the system, apparatus, structure, article, element, component, or hardware to perform the specified function without further modification. For purposes of this disclosure, a system, apparatus, structure, article, element, component, or hardware described as being "configured to" perform a particular function may additionally or alternatively be described as being "adapted to" and/or as being "operative to" perform that function.

Within examples, the disclosure herein provides an improved anti-fatigue floor mat design.

Various other features of the example devices and systems discussed above, as well as methods for using these devices, are also described hereinafter with reference to the accompanying figures.

With reference to the Figures, FIG. 1 illustrates a mat 100, according to an example embodiment. As shown in FIG. 1, the mat 100 includes a base 102 having a top surface 104 and a bottom surface 106. The mat 100 also includes a plurality of cylindrical supports 108 extending away from the bottom surface 106 of the base 102. Each of the plurality of cylindrical supports 108 has a first end 110 and a second end 112. The first end 110 of each of the plurality of cylindrical supports 108 is coupled to the bottom surface 106 of the base 102. The second end 112 of each of the plurality of cylindrical supports 108 includes a plurality of semi-circular cutouts 114. The plurality of cylindrical supports 108 are spaced apart by a separation distance 116 in a first plurality of rows 118 on the bottom surface 106 of the base 102. As shown in FIG. 1, adjacent rows of the first plurality of rows 118 are offset by one half of the separation distance 117. As such, the plurality of cylindrical supports 108 are positioned in an "every-other" pattern on the bottom surface 106 of the base 102. The mat 100 also includes a plurality of secondary supports 120 extending away from the bottom surface 106 of the base 102. The plurality of secondary supports 120 are spaced apart by one half of the separation distance 117 in a second plurality of rows 122 on the bottom surface 106 of the base 102.

In one example, as shown in FIG. 1, each of the first plurality of rows 118 are parallel to each other. Further, as shown in FIG. 1, in one example each of the second plurality of rows 122 are parallel to each other, and each of the first plurality of rows 118 overlaps with each of the second plurality of rows 122. As such, the first plurality of rows 118 of the plurality of cylindrical supports 108 are layered on top of the second plurality of rows 122 of the plurality of secondary supports 120.

The separation distance 116 may range from about 80 mm to about 160 mm. As such, one half of the separation distance 117 may range from about 40 mm to about 80 mm. The base 102 may have a thickness ranging from about 4 mm to about 20 mm. Each of the plurality of cylindrical supports may have an outer diameter ranging from about 40 mm to about 80 mm.

Figure 2:
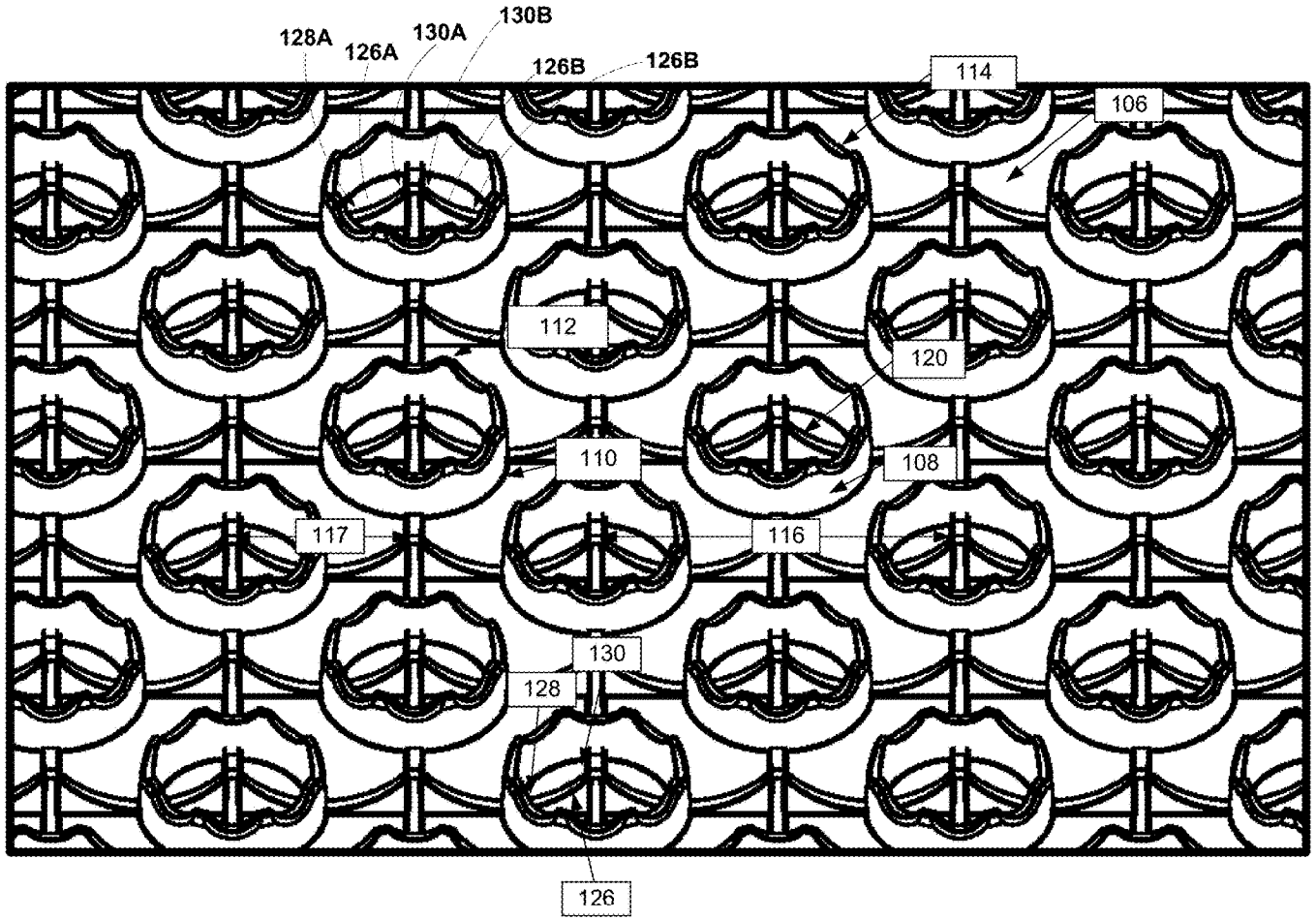
FIG. 2 illustrates a perspective view of a section of the mat of FIG. 1, according to an example embodiment.

FIG. 2 illustrates a section of the mat of FIG. 1, according to an example embodiment. As shown in FIG. 2 and as described above, the plurality of cylindrical supports 108 are spaced apart by a separation distance 116, and adjacent rows of the first plurality of rows 118 are offset by one half of the separation distance 117 so as to form an "every-other" pattern on the bottom surface 106 of the base 102. The plurality of secondary supports 120 are spaced apart by one half of the separation distance 117. As such, every other secondary support 120 of the plurality of secondary supports 120 is positioned inside of a given cylindrical support 108 of the plurality of cylindrical supports 108. In use, the plurality of cylindrical supports 108 maintain the base 102 in an upwardly spaced relation to a supporting surface when the mat 100 is positioned on the supporting surface.

In one particular example, as shown in FIGS. 1 and 2, the plurality of semi-circular cutouts 114 in each of the plurality of cylindrical supports 118 comprises eight semi-circular cutouts. In another example, the plurality of semi-circular cutouts 114 in each of the plurality of cylindrical supports 118 comprises four semi-circular cutouts. In yet another example, the plurality of semi-circular cutouts 114 in each of the plurality of cylindrical supports 118 comprises six semi-circular cutouts.

In one example, the top surface 104 of the base 102 includes a tread. The tread may assist in preventing slippage if the mat 100 gets wet. Further, as shown in FIG. 1, the mat 100 may include a border 132, the border 132 being integral to the mat 100 and framing a perimeter around the mat 100. The border 132 may be tapered from an interior portion of the mat 100 to the outer periphery edges. The border 132 may have a height that is substantially equal to the height of the plurality of cylindrical supports 108.

As shown in FIG. 1, the mat 100 may further include a plurality of cylindrical through-holes 134 extending away from the bottom surface 106 of the base 102. The plurality of cylindrical through-holes 134 may provide a hole connecting or locating the top surface 104 of the base 102 and the bottom surface 106 of the base 102. The plurality of cylindrical through-holes 134 may be used to pass bolts or other attachment mechanisms to secure the mat 100 to a support surface, such as a cab of a forklift as an example. In another example, the plurality of cylindrical through-holes 134 may be used to drain water or other liquids away from the top surface 104 of the base.

Figure 3:
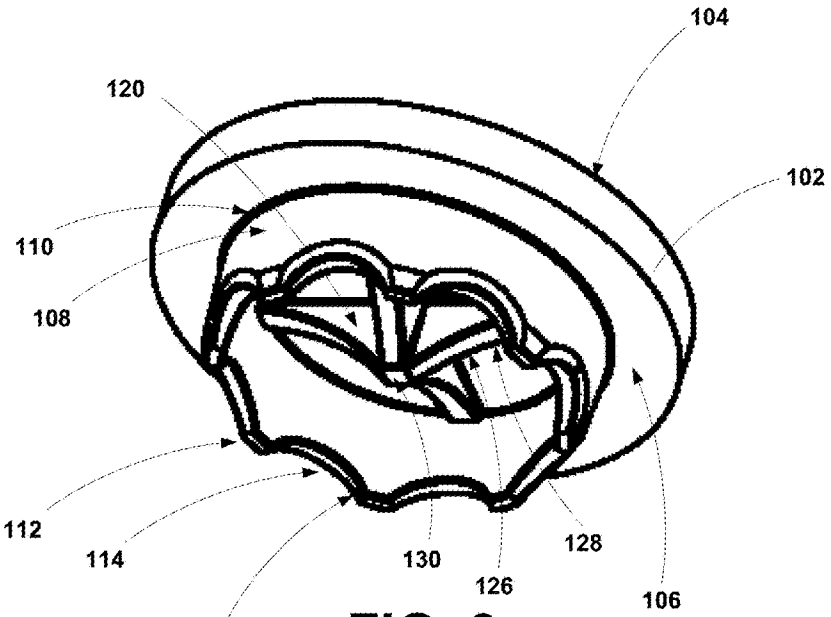
FIG. 3 illustrates a perspective view of a cylindrical support of the mat of FIG. 1, according to an example embodiment.
Figure 4:
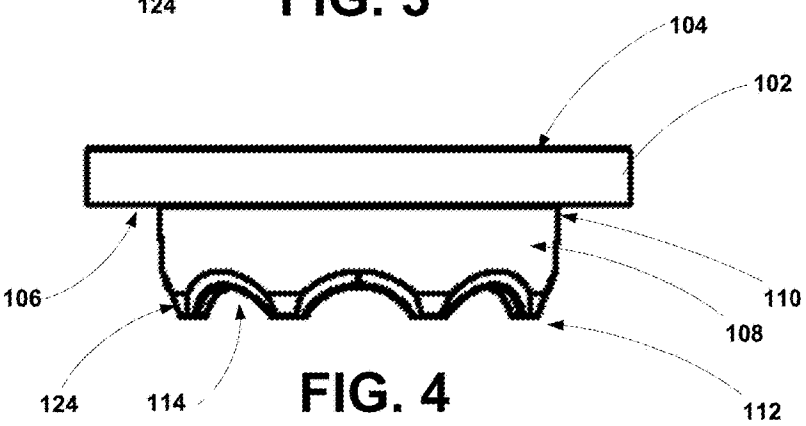
FIG. 4 illustrates a side view of the cylindrical support of FIG. 3, according to an example embodiment.
Figure 5:
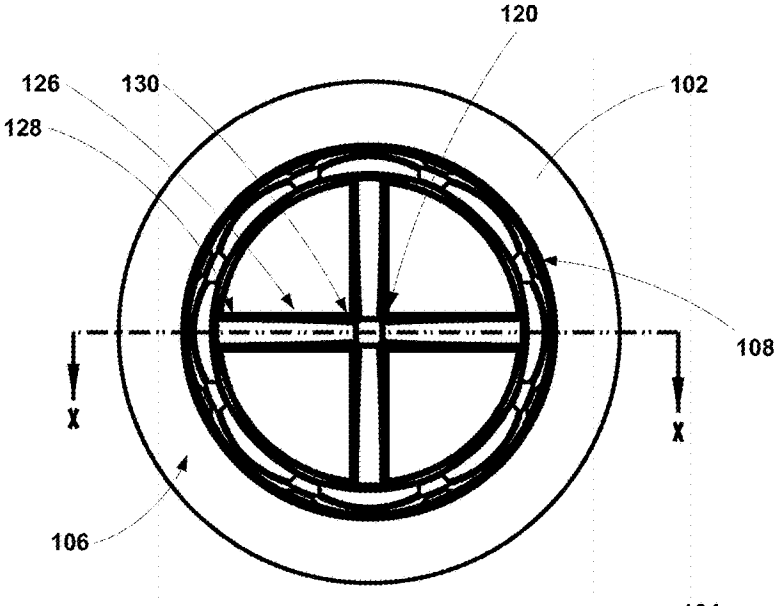
FIG. 5 illustrates a bottom view of the cylindrical support of FIG. 3, according to an example embodiment.
Figure 6:
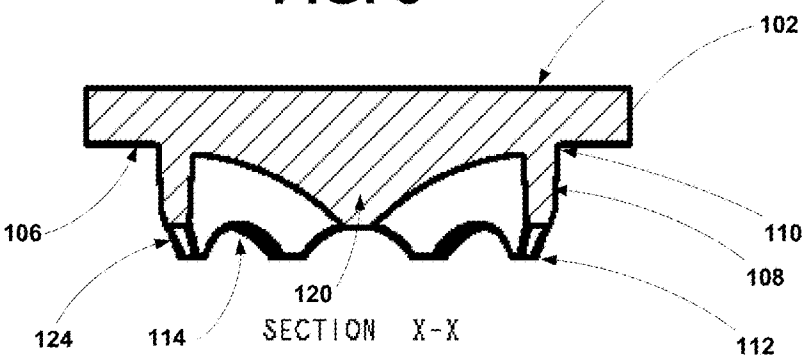
FIG. 6 illustrates a cross-section view of the cylindrical support of FIG. 3, according to an example embodiment.

FIGS. 3-6 illustrate an example cylindrical support of the plurality of cylindrical supports 108 of the mat 100 shown in FIGS. 1 and 2. In particular, FIG. 3 illustrates a perspective view of an example cylindrical support 108. As shown in FIG. 3, an exterior edge 124 of the second end 112 of each of the plurality of cylindrical supports 108 is chamfered. The chamfer may have a width ranging from about 1 mm to about 5 mm, and may have a height ranging from about 3 mm to about 10 mm. As such, the chamfer may be taller than it is wide.

The chamfered exterior edge 124 of the second end 112 of each of the plurality of cylindrical supports 108 may help bias the exterior edge 124 to buckle inward towards a center of the cylindrical support 108 when a load is applied to the top surface 104 of the base 102 when the mat 100 is in use.

In one example, as shown in FIGS. 3-6, a height of each of the plurality of cylindrical supports 108 is greater than a height of each of the plurality of secondary supports 120. In one particular example, the height of each of the plurality of cylindrical supports 108 is about 5 mm greater than the height of each of the plurality of secondary supports 120. Such an arrangement enables a first deflection of only the cylindrical supports 108. After the cylindrical supports 108 have been deflected by the distance corresponding to a difference between the height of the cylindrical supports 108 and the height of the secondary supports 120, the secondary supports 120 are engaged. Such an arrangement prevents the feel of hollow spots under or on the edge of a foot of a user, as there is no direct line for an edge of a foot to sink into a hollow spot without contacting the cylindrical supports 108 and/or contacting the secondary supports 120.

In one example, as shown in FIGS. 1-3 and 5, each of the plurality of secondary supports 120 comprises a plurality of ribs 126 each having a first end 128 and a second end 130. The first end 128A of a first rib 126A of the plurality of ribs 126 is coupled to a cylindrical support 108 of the plurality of cylindrical supports, and the second end 130 of the first rib 126A of the plurality of ribs 126 is coupled to the second end 130B of a second rib 126B of the plurality of ribs 126 at a center of the cylindrical support 108. In one example, each of the plurality of ribs 126 have a radius of curvature from the first end 128 to the second end 130, such that the second end 130 of each of the plurality of ribs 126 is positioned further away from the bottom surface 106 of the base 102 than the first end 128 of each of the plurality of ribs 126. The radius of curvature may range from about 5 mm to about 20 mm. In one particular example, as shown in FIGS. 1-3 and 5, the plurality of ribs 126 comprises four ribs rotated ninety degrees with respect to one another. Other number of ribs 126 are possible as well.

Figure 7:
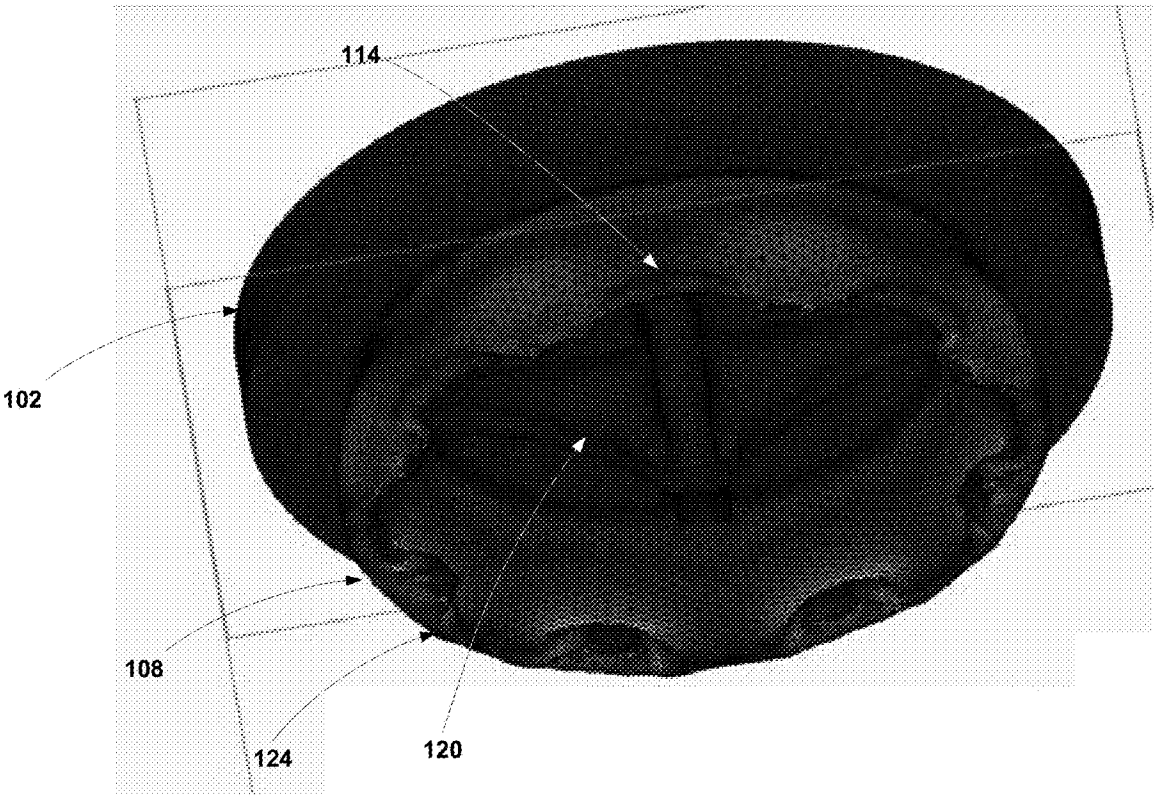
FIG. 7 illustrates a perspective view of a cylindrical support under stress, according to an example embodiment.

In one example, each of the base 102, the plurality of cylindrical supports 108, and the plurality of secondary supports 120 are formed integrally such that they each comprise the same material. In one example, the material comprises an elastic material having a Shore A durometer between about 30 and about 80, and preferably having a Shore A durometer between about 50 and about 80. In particular, the following materials are non-limiting examples of materials that could be used to form the various components of the mat 100: Natural Rubber, SBR, Neoprene, EPDM, Nitrile, Butyl, and Silicone. FIG. 7 illustrates a perspective view of an example cylindrical support 108 under stress, according to an example embodiment. As shown in FIG. 7, when a load is applied to the top surface 104 of the base 102, the chamfered exterior edge 124 of the second end 112 of each of the plurality of cylindrical supports 108 helps bias the exterior edge 124 to buckle inward towards a center of the cylindrical support 108 when a load is applied to the top surface 104 of the base 102 when the mat 100 is in use. Further, the plurality of cutouts 114 of each of the plurality of cylindrical supports 108 further reduces the stiffness of the cylindrical supports 108 and biases the cylindrical supports 108 to uniformly buckle.

It should be understood that arrangements described herein are for purposes of example only. As such, those skilled in the art will appreciate that other arrangements and other elements (e.g. machines, interfaces, functions, orders, and groupings of functions, etc.) can be used instead, and some elements may be omitted altogether according to the desired results.

Further, many of the elements that are described are functional entities that may be implemented as discrete or distributed components or in conjunction with other components, in any suitable combination and location, or other structural elements described as independent structures may be combined.

While various aspects and embodiments have been disclosed herein, other aspects and embodiments will be apparent to those skilled in the art. The various aspects and embodiments disclosed herein are for purposes of illustration and are not intended to be limiting, with the true scope being indicated by the following claims, along with the full scope of equivalents to which such claims are entitled. It is also to be understood that the terminology used herein is for the purpose of describing particular embodiments only, and is not intended to be limiting.

Since many modifications, variations, and changes in detail can be made to the described example, it is intended that all matters in the preceding description and shown in the accompanying figures be interpreted as illustrative and not in a limiting sense. Further, it is intended to be understood that the following clauses (and any combination of the clauses) further describe aspects of the present description.

What is claimed is:

1. A mat comprising:

a base having a top surface and a bottom surface;

a plurality of cylindrical supports extending away from the bottom surface of the base, wherein a first end of each of the plurality of cylindrical supports is coupled to the bottom surface of the base, wherein a second end of each of the plurality of cylindrical supports includes a plurality of semi-circular cutouts, wherein the plurality of cylindrical supports are spaced apart by a separation distance in a first plurality of rows on the bottom surface of the base, and wherein adjacent rows of the first plurality of rows are offset by one half of the separation distance; and a plurality of secondary supports extending away from the bottom surface of the base, wherein the plurality of secondary supports are spaced apart by one half of the separation distance in a second plurality of rows on the bottom surface of the base.

2. The mat of claim 1, wherein each of the first plurality of rows are parallel to each other.

3. The mat of claim 2, wherein each of the second plurality of rows are parallel to each other, and wherein the first plurality of rows overlaps with the second plurality of rows.

4. The mat of claim 1, wherein the plurality of cylindrical supports maintain the base in an upwardly spaced relation to a supporting surface when the mat is positioned on the supporting surface.

5. The mat of claim 1, wherein an exterior edge of the second end of each of the plurality of cylindrical supports includes a chamfer.

6. The mat of claim 5, wherein a height of the chamfer is greater than a width of the chamfer on the exterior edge of the second end of each of the plurality of cylindrical supports.

7. The mat of claim 1, wherein a height of each of the plurality of cylindrical supports is greater than a height of each of the plurality of secondary supports.

8. The mat of claim 7, wherein the height of each of the plurality of cylindrical supports is about 5 mm greater than the height of each of the plurality of secondary supports.

9. The mat of claim 1, wherein each of the plurality of secondary supports comprises a plurality of ribs each having a first end and a second end, wherein the first end of a first rib of the plurality of ribs is coupled to a cylindrical support of the plurality of cylindrical supports, and wherein the second end of the first rib of the plurality of ribs is coupled to the second end of a second rib of the plurality of ribs at a center of the cylindrical support.

10. The mat of claim 9, wherein each of the plurality of ribs have a radius of curvature from the first end to the second end, such that the second end of each of the plurality of ribs is positioned further away from the bottom surface of the base than the first end of each of the plurality of ribs.

11. The mat of claim 9, wherein the plurality of ribs comprises four ribs.

12. The mat of claim 1, wherein each of the base, the plurality of cylindrical supports, and the plurality of secondary supports are formed integrally such that they each comprise the same material.

13. The mat of claim 12, wherein the material comprises an elastic material having a Shore A durometer between about 30 and about 80.

14. The mat of claim 1, wherein the plurality of semi-circular cutouts in each of the plurality of cylindrical supports comprises eight semi-circular cutouts.

15. The mat of claim 1, wherein the separation distance ranges from about 80 mm to about 160 mm.

16. The mat of claim 1, wherein the base has a thickness ranging from about 4 mm to about 20 mm.

17. The mat of claim 1, wherein each of the plurality of cylindrical supports have an outer diameter range from about 40 mm to about 80 mm.

18. The mat of claim 1, wherein the top surface of the base includes a tread.

19. The mat of claim 1, wherein the mat includes a border, the border being integral to the mat and framing a perimeter around the mat.

* * * * *